US012311500B2

(12) United States Patent
Zhang et al.

(10) Patent No.: US 12,311,500 B2
(45) Date of Patent: May 27, 2025

(54) POLISHING LIQUID SUPPLY SYSTEM, POLISHING APPARATUS, EXHAUSTING METHOD AND POLISHING METHOD

(71) Applicant: CHANGXIN MEMORY TECHNOLOGIES, INC., Hefei (CN)

(72) Inventors: Peng Zhang, Hefei (CN); Fan-Wei Liao, Hefei (CN)

(73) Assignee: CHANGXIN MEMORY TECHNOLOGIES, INC., Hefei (CN)

( * ) Notice: Subject to any disclaimer, the term of this patent is extended or adjusted under 35 U.S.C. 154(b) by 913 days.

(21) Appl. No.: 17/486,619

(22) Filed: Sep. 27, 2021

(65) Prior Publication Data

US 2022/0339757 A1 Oct. 27, 2022

Related U.S. Application Data

(63) Continuation of application No. PCT/CN2021/109119, filed on Jul. 29, 2021.

(30) Foreign Application Priority Data

Apr. 23, 2021 (CN) ..... 202110440910.1

(51) Int. Cl.
*B24B 57/02* (2006.01)
*B24B 37/005* (2012.01)

(52) U.S. Cl.
CPC ..... *B24B 57/02* (2013.01); *B24B 37/005* (2013.01)

(58) Field of Classification Search
CPC . B24B 37/005; B24B 37/0056; B24B 37/015; B24B 37/04; B24B 37/042;
(Continued)

(56) References Cited

U.S. PATENT DOCUMENTS 5,275,740 A * 1/1994 Spyker ..... B01D 25/12 210/224
6,860,723 B2 * 3/2005 Chen ..... F04B 49/20 417/313

(Continued)

FOREIGN PATENT DOCUMENTS

CN 1487576 A 4/2004
CN 1607975 A 4/2005

(Continued)

OTHER PUBLICATIONS

CN 102001044—Machine Translation (Year: 2011).*

(Continued)

*Primary Examiner* — Brian D Keller
*Assistant Examiner* — Alberto Saenz
(74) *Attorney, Agent, or Firm* — Kilpatrick Townsend & Stockton LLP

(57) ABSTRACT

A polishing liquid supply system, polishing apparatus, exhausting method and polishing method are provided. The system includes a polishing liquid filter; a sensor for detecting whether there are bubbles in the polishing liquid filter; a controller which is connected to the polishing machine and the sensor, and configured to send an exhaust signal when the polishing machine is in an idle state and the sensor detects that there are bubbles in the polishing liquid filter; and an exhaust unit which includes an exhaust pipeline and a control valve, wherein the exhaust pipeline is in communication with the inside of the polishing liquid filter, and the control valve is arranged on the exhaust pipeline and is connected to the controller for opening after receiving the exhaust signal so as to exhaust the bubbles.

11 Claims, 3 Drawing Sheets

(58) Field of Classification Search
CPC ..... B24B 37/07; B24B 37/10; B24B 37/105; B24B 37/34; B24B 57/00; B24B 57/02; B24B 57/04; B24B 49/12; B24B 55/02; B24B 55/03; B24B 55/12; B28D 1/025; B24C 9/006; F16K 31/12
USPC ..... 451/5, 60, 446, 447; 417/38, 40, 43, 53, 417/63; 137/11, 42, 111, 113, 197, 199, 137/202; 96/176, 177, 178, 179, 180
See application file for complete search history.

(56) References Cited

U.S. PATENT DOCUMENTS

| | | | | |
|---|---|---|---|---|
| 2004/0071555 | A1 | 4/2004 | Chen | |
| 2008/0060525 | A1* | 3/2008 | Lee | B01D 19/0073 96/180 |
| 2015/0262833 | A1 | 9/2015 | Shibuya et al. | |
| 2016/0332278 | A1 | 11/2016 | Shibuya et al. | |
| 2018/0283563 | A1* | 10/2018 | Goto | F16K 31/1221 |
| 2020/0101582 | A1* | 4/2020 | Liu | B24B 37/042 |

FOREIGN PATENT DOCUMENTS

| | | | | | |
|---|---|---|---|---|---|
| CN | 101143275 | A | | 3/2008 | |
| CN | 102001044 | A | * | 4/2011 | F04B 49/20 |
| CN | 202082023 | U | | 12/2011 | |
| CN | 102806526 | A | | 12/2012 | |
| CN | 203019229 | U | | 6/2013 | |
| CN | 104907917 | A | | 9/2015 | |
| CN | 106625254 | A | | 5/2017 | |
| CN | 107081005 | A | | 8/2017 | |
| CN | 108145606 | A | | 6/2018 | |
| CN | 109381917 | A | | 2/2019 | |
| CN | 208913880 | U | | 5/2019 | |
| CN | 210205982 | U | | 3/2020 | |
| CN | 113103150 | A | | 7/2021 | |
| TW | M526752 | U | | 8/2016 | |

OTHER PUBLICATIONS

Office Action of the Chinese application No. 202110440910.1, issued on Aug. 5, 2022, 18 pgs.
First Office Action of the Chinese application No. 202110440910.1, issued on Mar. 25, 2022, 11 pgs.

* cited by examiner

POLISHING LIQUID SUPPLY SYSTEM, POLISHING APPARATUS, EXHAUSTING METHOD AND POLISHING METHOD

CROSS-REFERENCE TO RELATED APPLICATION

This is a continuation application of International Patent Application No. PCT/CN2021/109119, filed on Jul. 29, 2021, which claims priority to Chinese patent application No. 202110440910.1, filed on Apr. 23, 2021 and entitled "POLISHING LIQUID SUPPLY SYSTEM, POLISHING APPARATUS, EXHAUSTING METHOD AND POLISHING METHOD". The disclosures of International Patent Application No. PCT/CN2021/109119 and Chinese patent application No. 202110440910.1 are incorporated by reference herein in their entireties.

TECHNICAL FIELD

This disclosure relates to a field of semiconductor manufacturing, and in particular to a polishing liquid supply system, polishing apparatus, exhausting method, and polishing method.

BACKGROUND

In the manufacturing process of integrated circuit, with the reduction of the feature size and the increase of metal interconnection, the requirements for the flatness of the wafer surface are getting higher. Chemical Mechanical Polishing (CMP) is a technique in which mechanical polishing and chemical etching are combined, and is the most effective method of planarizing the wafer and widely used in semiconductor manufacturing.

During the polishing, it is necessary to filter out the large particle slurry in the polishing liquid according to the requirements for the polishing process, which needs to be achieved by means of the polishing liquid filter. In addition, since the polishing liquid generally includes hydrogen peroxide and other components that can be naturally decomposed into water and oxygen, there are often some gases in the polishing liquid filter. When replacing the polishing liquid filter, it is necessary to manually discharge the bubbles from the polishing liquid filter.

However, the polishing liquid is a chemical agent, which has a risk of being splashed on personnel and endangers personal safety. In addition, the operation procedure of exhausting bubbles is complicated, which causes the loss of manpower and utilization rate of the machine.

SUMMARY

In one aspect, the present disclosure provides a polishing liquid supply system, which includes: a polishing liquid filter, a sensor for detecting whether there are bubbles in the polishing liquid filter, a controller and an exhaust unit. The controller is connected to the polishing machine and the sensor and configured to send an exhaust signal when the polishing machine is in an idle state and the sensor detects that there are bubbles in the polishing liquid filter. The exhaust unit comprises an exhaust pipeline and a control valve, the exhaust pipeline is in communication with the inside of the polishing liquid filter, and the control valve is arranged on the exhaust pipeline and is connected to the controller. The control valve is configured to be opened after receiving the exhaust signal to exhaust the bubbles.

In another aspect, the present disclosure further provides a polishing apparatus, which includes a polishing liquid supply system according to the above embodiment, and a polishing machine connected to the controller.

In another aspect, the present disclosure further provides an exhausting method which is applied to the polishing liquid supply system according to the above embodiments, and includes the following operations: detecting whether there are bubbles in the polishing liquid filter by the sensor; monitoring the state of the polishing machine in real time by the controller, and sending an exhaust signal when the polishing machine is in an idle state and the sensor detects that there are bubbles in the polishing liquid filter; and opening the control valve after the control valve receives the exhaust signal to exhaust the bubbles.

In another aspect, the present disclosure further provides a polishing method, which is performed by the polishing apparatus according to the above embodiments, and includes the following operations: supplying polishing liquid into the polishing liquid filter; performing the exhausting method according to any one of embodiments; and supplying the polishing liquid filtered by the polishing liquid filter to the polishing machine.

BRIEF DESCRIPTION OF THE DRAWINGS

In order to more clearly describe the embodiments of the present disclosure or the technical solutions in the traditional technology, the following will briefly introduce the drawings that need to be used in the description of the embodiments or the traditional technology. Obviously, the drawings in the following description are merely some embodiments of the present disclosure, and other drawings can be obtained based on these drawings without any creative effort for those skilled in the art.

The description of the drawing numbers.

Figure 1:
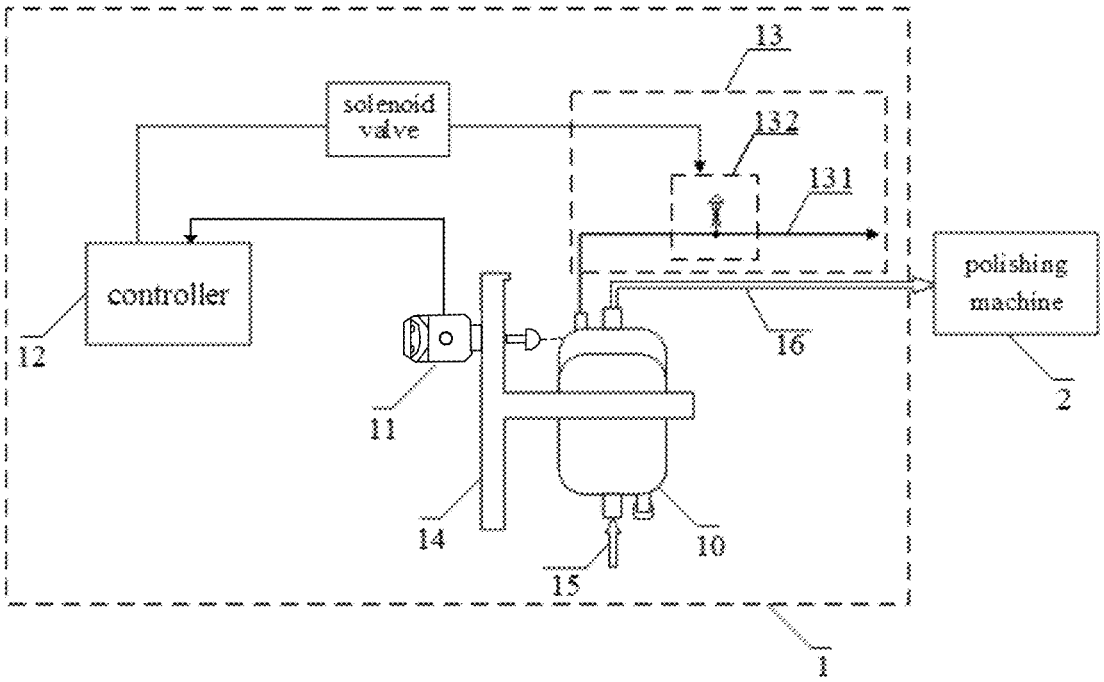
FIG. 1 illustrates a schematic view of a polishing liquid supply system according to one of the embodiments of the present disclosure, which is also a schematic view of a polishing apparatus according to one of the embodiments of the present disclosure.

1—a polishing liquid supply system, 10—a polishing liquid filter, 11—a sensor, 12—a controller, 13—an exhaust unit, 131—an exhaust pipeline, 132—a control valve, 14—a filter holder, 15—a first liquid supply pipeline, 16—a second liquid supply pipeline, 2—a polishing machine.

DETAILED DESCRIPTION

In order to facilitate the understanding of the present disclosure, the present disclosure will be described below in a more comprehensive manner with reference to the relevant drawings. The preferred embodiment of the present disclosure is shown in the drawings. However, the present disclosure can be implemented in many different forms and is not limited to the embodiments described herein. On the contrary, the objective of providing these embodiments is to make the disclosure of the present disclosure more thorough and comprehensive.

Unless otherwise defined, all technical and scientific terms used herein have the same meaning as commonly understood by those skilled in the art of the present disclosure. The terms used in the specification of the present disclosure herein is not intended to limit the present disclosure, but is only for the objective of describing specific embodiments.

It should be understood that when an element is referred to as being "on", "adjacent to" or "connected to" other elements, it can be directly on, adjacent to, or connected to other elements, or there may be intervening elements. In contrast, when an element is referred to as being "directly on," "directly adjacent to," or "directly connected to" other elements, there are no intervening elements. It should be understood that although the terms of first, second, etc. may be used to describe various elements, components, and/or parts, these elements, components, and/or parts should not be limited by these terms. These terms are only used to distinguish one element, component or part from another element, component or part. Therefore, without departing from the teachings of the present disclosure, the first element, component or part discussed below can be represented as a second element, component or part, for example, the first liquid supply pipeline can be referred to as the second liquid supply pipeline, and similarly, the second liquid supply pipeline can be referred to as the first liquid supply pipeline, wherein the first liquid supply pipeline and the second liquid supply pipeline are different liquid supply pipelines, for example, the first liquid supply pipeline can be used to supply the polishing liquid into the polishing liquid filter, and the second liquid supply pipeline can be used to supply the filtered polishing liquid to the polishing machine.

Spatial relationship terms such as "under . . . ", "below . . . ", " . . . below", "under . . . of . . . ", "above . . . of . . . ", " . . . above", etc., can be used to describe the relationship between one element or feature shown in the drawings and other elements or features therein. It should be understood that, in addition to the orientations shown in the drawings, the spatial relationship terms further include various orientations of devices in use and operation.

When used herein, the singular forms of "a", "an" and "the/the said" may also include plural forms, unless the context clearly indicates otherwise. It should also be understood that when the terms "comprise" and/or "include" are used in this specification, the existence of the features, integers, steps, operations, elements and/or components can be determined, but the presence or addition of one or more other features, integers, steps, operations, elements, components, and/or groups are not excluded. Meanwhile, when used herein, the term "and/or" includes any and all combinations of related listed items.

Please refer to FIG. 1, the present disclosure provides a polishing liquid supply system 1, which is configured to supply polishing liquid to the polishing machine 2, and includes: a polishing liquid filter 10, a sensor 11 for detecting whether there are bubbles in the polishing liquid filter 10, a controller 12 and an exhaust unit 13. The controller is connected to the polishing machine 2 and the sensor 11 and configured to send an exhaust signal when the polishing machine 2 is in an idle state and the sensor 11 detects that there are bubbles in the polishing liquid filter 10. The exhaust unit 13 comprises an exhaust pipeline 131 and a control valve 132, the exhaust pipeline 131 is in communication with the inside of the polishing liquid filter 10, and the control valve 132 is arranged on the exhaust pipeline 131 and is connected to the controller 12. The control valve is configured to be opened after receiving the exhaust signal to exhaust the bubbles.

In the polishing liquid supply system 1 according to the above embodiments, when the sensor 11 detects there are bubbles in the polishing liquid filter 10, the exhaust unit 13 receives the exhaust signal from the controller 12 to exhaust the bubbles. The bubble discharge procedure therein is simple and convenient, which avoids the loss of manpower and utilization rate of the machine, and at the same time, the polishing liquid supply system 1 does not need to manually discharge bubbles from the polishing liquid filter 10, which can avoid the risk of splashing the polishing liquid to the operator and avoid endangering personal safety.

In one of the embodiments, the sensor 11 may include, but is not limited to, a liquid level sensor.

In the polishing liquid supply system 1 according to the above embodiments, the liquid level sensor, which is easy to install, is used to detect whether there are bubbles in the polishing liquid filter 10, so that the structure of the polishing liquid supply system 1 is simplified. Since the liquid level sensor can work in unfavorable environments such as polluted environment, humid environment, and environment having bubbles, it is adapted well to the measured object, has strong adaptability to the environment and does not affect the state of the measured object. In addition, the detecting signal is not affected by the environment, thereby improving the reliability. Moreover, the CMP polishing liquid contains hydrogen peroxide that will naturally decompose into water and oxygen in the polishing liquid filter 10, and such decomposition is unpredictable and the water and oxygen cannot be discharged in time, which will cause the polishing liquid flow to be unstable. In the polishing liquid supply system 1 according to the above embodiments, the liquid level sensor is used. Even if water and oxygen exist in the polishing liquid filter 10, the accuracy of detecting whether there are bubbles in the polishing liquid filter 10 will not be affected.

Specifically, in some embodiments, the liquid level sensor may include, but is not limited to, an optical fiber liquid level sensor, an ultrasonic liquid level sensor, a capacitive liquid level sensor, a photoelectric liquid level sensor, or a microwave optical liquid level sensor. In one example, the liquid level sensor of the present disclosure may be an optical fiber liquid level sensor.

Please continue to refer to FIG. 1, in one of the embodiments, the polishing liquid supply system 1 may further include a filter holder 14; the polishing liquid filter 10 is arranged on the filter holder 14.

In the polishing liquid supply system 1 provided in the above embodiments, by arranging the polishing liquid filter 10 on the filter holder 14, the structure of the polishing liquid supply system 1 is more compact, and the workspace required by the polishing liquid supply system 1 can be saved.

Please continue to refer to FIG. 1, in one of the embodiments, the sensor 11 is arranged the filter holder 14.

In the polishing liquid supply system 1 provided in the above embodiments, by arranging the sensor 11 on the filter holder 14, the sensor 11 does not require additional other support structures, so that the structure of the polishing liquid supply system 1 is more compact, and can save the workspace required for the polishing liquid supply system 1.

In one of the embodiments, the control valve 132 may include, but is not limited to the pneumatic valve.

The pneumatic valve has a fast execution speed and small volume, and can be opened and closed easily. In the polishing liquid supply system 1 in the above embodiments, the exhaust signal is received by the pneumatic valve which is opened after receiving the exhaust signal so as to exhaust the bubbles, which not only makes the bubble discharge procedure simply and reliably, but also makes the maintenance of the polishing liquid supply system 1 convenient.

Specifically, in one of the embodiments, the pneumatic valve may include, but is not limited to an opening degree adjustable pneumatic valve with corrosion resistance.

In the polishing liquid supply system 1 in the above embodiments, the use of the opening degree adjustable pneumatic valve with corrosion resistance can prevent the valve body from being corroded by acid and alkali to affect its working performance, thereby ensuring the reliability of the polishing liquid supply system 1.

In other examples, the control valve 132 may further include a pneumatic valve and a solenoid valve, at this time, as shown in FIG. 1, the pneumatic valve is provided on the exhaust pipeline 131, and the solenoid valve may be located on the connection pipeline between the pneumatic valve and the controller 12.

In the polishing liquid supply system 1 according to one of the embodiments, during the control valve 132 is opened to perform the exhausting, the controller 12 may be further configured to send a closing signal when the polishing machine 2 enters a working state from an idle state or when the sensor 11 detects that there is no bubble in the polishing liquid filter 10, and the control valve 132 may be further configured to be closed after receiving the closing signal so as to stop exhausting.

In the polishing liquid supply system 1 according to the above embodiments, the operation of discharging bubbles is performed only when the polishing machine 2 is in an idle state, which will not affect the working state of the polishing machine 2 and avoid the loss of the utilization rate of the polishing machine 2. When the polishing machine 2 enters a working state from an idle state or the sensor 11 detects that there is no bubble in the polishing liquid filter 10, the exhausting is stopped, which can ensure the working safety of the polishing machine 2.

In one of the embodiments, the controller 12 may include, but is not limited to the machine controller of the polishing machine 2. Certainly, in other examples, the controller 12 may also be an independent controller in addition to the machine controller of the polishing machine 2.

Please continue to refer to FIG. 1, in one of the embodiments, the polishing liquid supply system 1 may further include: a polishing liquid supply device (not shown in the figure), a first liquid supply pipeline 15 and a second liquid supply pipeline 16. The first liquid supply pipeline 15 is configured to supply the polishing liquid into the polishing liquid filter 10, one end of the first liquid supply pipeline is connected to the polishing liquid supply device, and the other end of the first liquid supply pipeline is connected to the polishing liquid filter 10. The second liquid supply pipeline 16 is configured to supply the filtered polishing liquid to the polishing machine 2, one end of the second liquid supply pipeline is connected to the polishing liquid filter 10, and the other end of the second liquid supply pipeline is extended to the polishing machine 2.

Please continue to refer to FIG. 1, the present disclosure further provides a polishing apparatus which includes a polishing liquid supply system 1 according to anyone of the above embodiments, and a polishing machine 2 connected to the controller 12.

Specifically, for the specific structure of the polishing liquid supply system 1, please refer to the above contents, which will not be repeated herein. The polishing machine 2 may be any polishing machine used in the semiconductor field, and the specific structure of the polishing machine 2 will not be described here.

Figure 2:
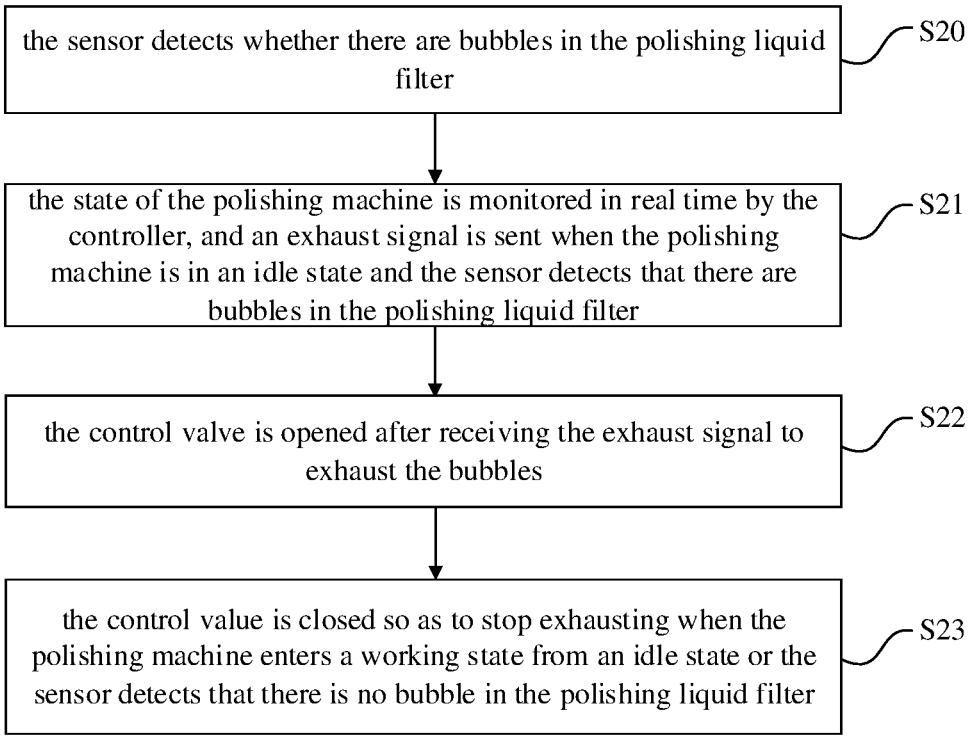
FIG. 2 illustrates a schematic flow chart of the exhausting method according to one of the embodiments of the present disclosure.

Please refer to FIG. 2, the present disclosure further provides an exhausting method that is applied to the polishing liquid supply system 1 according to anyone of the above embodiments, which comprises the following operation.

In S20, the sensor 11 detects whether there are bubbles in the polishing liquid filter 10;

In S21, the state of the polishing machine 2 is detected in real time by the controller 12, and an exhaust signal is sent when the polishing machine 2 is in an idle state and the sensor 11 detects that there are bubbles in the polishing liquid filter 10;

In S22, the control valve 132 is opened after receiving the exhaust signal to exhaust the bubbles.

In the exhausting method according to the above embodiments, when the polishing machine 2 is in an idle state and the sensor 11 detects that there are bubbles in the polishing liquid filter 10, an exhaust signal can be sent to control the exhaust unit 13 to perform the exhausting. The exhausting method has a simple and convenient procedure, which avoids the loss of manpower and utilization rate of the machine, and at the same time, the exhausting method does not need to manually discharge bubbles from the polishing liquid filter 10, which can avoid the risk of splashing the polishing liquid to the operator and avoid endangering personal safety.

In one of the embodiments, the sensor 11 may determine whether there are bubbles in the polishing liquid filter 10 by detecting the liquid level in the polishing liquid filter 10.

In the exhausting method according to the above embodiments, the sensor determine whether there are bubbles in the polishing liquid filter 10 by detecting the liquid level in the polishing liquid filter 10. Since the liquid level sensor is easy to install, the structure of the polishing liquid supply system 1 is simplified. Moreover, the CMP polishing liquid contains hydrogen peroxide that will naturally decompose into water and oxygen in the polishing liquid filter 10, and such decomposition is unpredictable and the water and oxygen cannot be discharged in time, which will cause the polishing liquid flow to be unstable. In the exhausting method provided in the above embodiments, whether there are bubbles in the polishing liquid filter 10 is determined by detecting the liquid level in the polishing liquid filter 10, and even if water and oxygen are present in the polishing liquid filter 10, the accuracy for detecting whether there are bubbles in the polishing liquid filter 10 will not be affected.

Please continue to refer to FIG. 2, in one of the embodiments, the following operation may be included after S22.

In S23, the control valve 132 is closed so as to stop exhausting when the polishing machine 2 enters a working state from an idle state or the sensor 11 detects that there are no bubbles in the polishing liquid filter 10.

In the exhausting method in the above embodiments, the operation of discharging bubbles is performed only when the polishing machine 2 is in an idle state, which will not affect the working state of the polishing machine 2 and avoid the loss of the utilization rate of the polishing machine 2.

Figure 3:
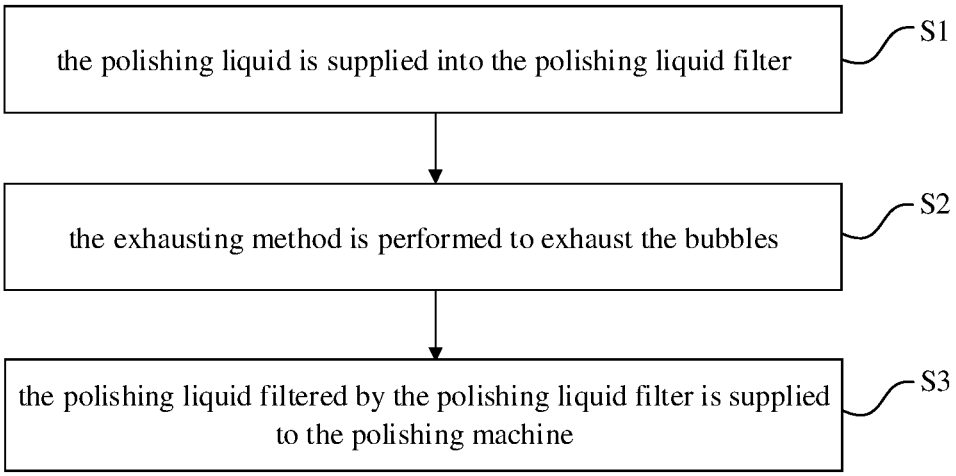
FIG. 3 illustrates a schematic flow chart of the polishing method according to one of the embodiments of the present disclosure.

Please refer to FIG. 3, the present disclosure further provides a polishing method that is performed by the polishing apparatus according to the above embodiments, which includes the following.

In 51, polishing liquid is supplied into the polishing liquid filter 10.

In S2, exhausting of the bubbles is performed by the exhausting method according to anyone of the above embodiments.

In S3, the polishing liquid filtered by the polishing liquid filter is supplied to the polishing machine 2.

In one of the embodiments, the polishing liquid may be supplied to the polishing liquid filter 10 when the polishing machine 2 is in an idle state.

In the polishing method in the above embodiments, the polishing liquid is supplied to the polishing liquid filter 10 when the polishing machine 2 is in an idle state, so as to avoid the lack of the polishing liquid when the polishing machine 2 is in a working state, and to avoid the loss of the utilization rate of the machine due to the supply of polishing liquid to the polishing machine 2 in the working state.

It should be understood that although the various operations in the flowcharts of FIGS. 2 and 3 are shown in sequence as indicated by the arrows, these operations are not necessarily performed in sequence in the order indicated by the arrows. Unless there is a clear description in this disclosure, there is no specific order for performing these operations, and these operations can be performed in other orders. Moreover, at least part of the operations in FIGS. 2 and 3 may include multiple operations or multiple stages, which are not necessarily performed at the same time, but can be performed at different times, and whose orders are not necessarily performed sequentially, but may be performed in turn or alternately with other operations or at least part of the operations or stages in other operations.

The various technical features of the above-mentioned embodiments can be combined arbitrarily. In order to make the description concise, all possible combinations of the various technical features of the above embodiments are not described. However, as long as there is no contradiction in the combination of these technical features, it should be regarded as the scope described in this specification.

The above-mentioned embodiments only express several implementation modes of the present disclosure, and their descriptions are relatively specific and detailed, but they should not be understood as limiting the scope of this patent application. It should be noted that for those skilled in the art, several modifications and improvements can be made without departing from the concept of the present disclosure, which belong to the claimed scope of the present disclosure. Therefore, the scope claimed by this patent application shall be subject to the appended claims.

The invention claimed is:

1. A polishing liquid supply system, configured to supply polishing liquid to a polishing machine, comprising:

a polishing liquid filter;

a sensor for detecting whether there are bubbles in the polishing liquid filter;

a controller, connected to the polishing machine and the sensor, and configured to send an exhaust signal when the polishing machine is in an idle state and the sensor detects that there are bubbles in the polishing liquid filter; and an exhaust unit comprising an exhaust pipeline and a control valve, wherein the exhaust pipeline is in communication with an inside of the polishing liquid filter, the control valve is arranged on the exhaust pipeline and is connected to the controller, the control valve is configured to be opened after receiving the exhaust signal to exhaust the bubbles;

wherein during the control valve is opened to exhaust the bubbles, the controller is further configured to send a closing signal when the polishing machine enters a working state from the idle state or when the sensor detects that there is no bubble in the polishing liquid filter, and wherein the control valve is further configured to be closed after receiving the closing signal to stop the exhausting.

2. The polishing liquid supply system according to claim 1, wherein the sensor comprises a liquid level sensor.

3. The polishing liquid supply system according to claim 1, further comprising: a filter holder, wherein the polishing liquid filter is arranged on the filter holder.

4. The polishing liquid supply system according to claim 3, wherein the sensor is arranged on the filter holder.

5. The polishing liquid supply system according to claim 1, wherein the control valve comprises a pneumatic valve.

6. The polishing liquid supply system according to claim 5, wherein the pneumatic valve is an opening degree adjustable pneumatic valve with corrosion resistance.

7. An exhausting method, applied to the polishing liquid supply system according to claim 1, comprising:

detecting whether there are bubbles in the polishing liquid filter by the sensor;

monitoring a state of the polishing machine in real time by the controller, and sending the exhaust signal when the polishing machine is in the idle state and the sensor detects that there are bubbles in the polishing liquid filter;

opening the control valve after the control valve receives the exhaust signal to exhaust the bubbles; and after opening the control valve to exhaust the bubbles, closing the control value to stop exhausting when the polishing machine enters a working state from the idle state or the sensor detects that there is no bubble in the polishing liquid filter.

8. The exhausting method according to claim 7, wherein the sensor determines whether there are bubbles in the polishing liquid filter by detecting a liquid level in the polishing liquid filter.

9. A polishing apparatus, comprising:

a polishing liquid supply system; and a polishing machine, wherein the polishing liquid supply system comprises:

a polishing liquid filter;

a sensor for detecting whether there are bubbles in the polishing liquid filter;

a controller, connected to the polishing machine and the sensor, and configured to send an exhaust signal when the polishing machine is in an idle state and the sensor detects that there are bubbles in the polishing liquid filter; and an exhaust unit comprising an exhaust pipeline and a control valve, wherein the exhaust pipeline is in communication with an inside of the polishing liquid filter, the control valve is arranged on the exhaust pipeline and is connected to the controller, the control valve is configured to be opened after receiving the exhaust signal to exhaust the bubbles, wherein the polishing machine is connected to the controller; and wherein during the control valve is opened to exhaust the bubbles, the controller is further configured to send a closing signal when the polishing machine enters a working state from the idle state or when the sensor detects that there is no bubble in the polishing liquid filter, and wherein the control valve is further configured to be closed after receiving the closing signal to stop the exhausting.

10. A polishing method performed by the polishing apparatus according to claim 9, comprising:

supplying polishing liquid into the polishing liquid filter;

detecting whether there are bubbles in the polishing liquid filter by the sensor;

monitoring a state of the polishing machine in real time by the controller, and sending the exhaust signal when the polishing machine is in the idle state and the sensor detects that there are bubbles in the polishing liquid filter; and opening the control valve after the control valve receives the exhaust signal to exhaust the bubbles;

supplying the polishing liquid filtered by the polishing liquid filter to the polishing machine; and after opening the control valve to exhaust the bubbles, closing the control value to stop exhausting when the polishing machine enters a working state from the idle state or the sensor detects that there is no bubble in the polishing liquid filter.

11. The polishing method according to claim 10, wherein the polishing liquid is supplied to the polishing liquid filter when the polishing machine is in the idle state.

* * * * *